US008740344B2

(12) United States Patent
Oguchi

(10) Patent No.: US 8,740,344 B2
(45) Date of Patent: Jun. 3, 2014

(54) INK-JET RECORDING APPARATUS

(71) Applicant: Tomoya Oguchi, Aichi-ken (JP)

(72) Inventor: Tomoya Oguchi, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/852,312

(22) Filed: Mar. 28, 2013

(65) Prior Publication Data

US 2013/0257962 A1 Oct. 3, 2013

(30) Foreign Application Priority Data

Mar. 30, 2012 (JP) ..... 2012-082035

(51) Int. Cl.
*B41J 2/165* (2006.01)

(52) U.S. Cl.
USPC ..... 347/29

(58) Field of Classification Search
USPC ..... 347/20, 22, 23, 29, 30
See application file for complete search history.

(56) References Cited

U.S. PATENT DOCUMENTS

| | | | | |
|---|---|---|---|---|
| 7,770,992 | B2 * | 8/2010 | Nakahara et al. | 347/14 |
| 8,287,084 | B2 * | 10/2012 | Ito | 347/23 |
| 8,628,170 | B2 * | 1/2014 | Takeda et al. | 347/33 |
| 2007/0048058 | A1 | 3/2007 | Koga et al. | |
| 2007/0048059 | A1 | 3/2007 | Asada et al. | |
| 2007/0057447 | A1 | 3/2007 | Asada et al. | |
| 2011/0050780 | A1 | 3/2011 | Mizutani et al. | |

FOREIGN PATENT DOCUMENTS

| | | | |
|---|---|---|---|
| JP | H08-118611 | A | 5/1996 |
| JP | 2007-090761 | A | 4/2007 |
| JP | 2011-051178 | A | 3/2011 |
| JP | 2012-000898 | A | 1/2012 |

* cited by examiner

*Primary Examiner* — Lamson Nguyen

(74) *Attorney, Agent, or Firm* — Scully, Scott, Murphy & Presser, PC

(57) ABSTRACT

In an ink-jet recording apparatus, when a controller receives an image recording command for a sheet placed on a manual feed tray in a state in which a cap is in a first posture in which the cap covers a nozzle face, the controller is configured to rotate the motor in a first direction by a first rotation amount smaller than a complete switch rotation amount required for the image recording. And, the controller is configured to rotate the motor in a second direction by a second rotation amount equal to or less than the first rotation amount. Then, the controller is configured to rotate the motor in the first direction by a difference rotation amount between the complete switch rotation amount and the first rotation amount.

11 Claims, 12 Drawing Sheets

FIG.11

| ROTATIONAL DIRECTION OF CONVEYANCE MOTOR | DESTINATION OF TRANSMISSION OF ROTATIONAL DRIVE FORCE | |
|---|---|---|
| | FIRST DRIVING STATE | SECONDE DRIVING STATE |
| FIRST DIRECTION | ·CONVEYANCE ROLLER FOR CONVEYANCE IN FORWARD CONVEYING DIRECTION<br>·LOCK MECHANISM FOR LOCKING/RELEASING<br>·WIPER BLADE FOR ASCENDING/DESCENDING<br>·PORT SWITCHING MECHANISM FOR SWITCHING | ·CONVEYANCE ROLLER FOR CONVEYANCE IN FORWARD CONVEYING DIRECTION |
| SECOND DIRECTION | ·CONVEYANCE ROLLER FOR CONVEYANCE IN BACKWARD CONVEYING DIRECTION<br>·PUMP FOR DRIVING | ·SHEET SUPPLY ROLLER FOR SHEET SUPPY |

FIG.12

| PORT SWITCHING MECHANISM | CONVEYANCE DISTANCE [mm] | SHEET POSITION [mm] |
|---|---|---|
| LOCK STATE | 0 | 0 |
| BK EMPTY SUCTION STATE | 39 | 39 |
| PUMP DRIVE | −29 | 10 |
| CO EMPTY SUCTION STATE | 35 | 45 |
| PUMP DRIVE | −35 | 10 |
| SCANNABLE STATE | 20 | 30 |

INK-JET RECORDING APPARATUS

CROSS REFERENCE TO RELATED APPLICATION

The present application claims priority from Japanese Patent Application No. 2012-082035, which was filed on Mar. 30, 2012, the disclosure of which is herein incorporated by reference in its entirety.

BACKGROUND OF THE INVENTION

1. Field of the Invention

The present invention relates to an ink-jet recording apparatus configured to record an image on a sheet supplied from a manual feed tray.

2. Description of Related Art

There is known an ink-jet recording apparatus having a maintenance mechanism configured to protect a nozzle of a recording head and to perform a maintenance. The maintenance mechanism has a cap that moves up and down in order to cover and uncover the recording head. An internal space of the cap is connected to a suction pump via a tube and the like. The suction pump suctions an air inside the cap, thereby suctioning a waste ink remaining in the nozzle. The maintenance mechanism may have a switching portion capable of switching a state of the communication among a plurality of ports. Some of the plurality of ports are connected to the cap and the suction pump. For example, the switching portion is configured to switch the state of the communication to a state in which the inside space of the cap and the suction pump communicate with each other, a state in which the inside space of the cap and the suction pump do not communicate with each other, and a state in which the inside space of the cap is open to an ambient air.

The maintenance mechanism may be driven by a motor that is also used for driving a conveyance roller which conveys a sheet. As an example, when the motor rotates forward, the conveyance roller rotates in a direction in which the sheet is conveyed in a forward conveying direction in which the sheet is conveyed for a printing while the state of the communication in the switching portion is switched. When the motor rotates reversely, the conveyance roller rotates in a direction in which the sheet is conveyed in a backward conveying direction opposite to the forward conveying direction.

SUMMARY OF THE INVENTION

The ink-jet recording apparatus may include a manual feed tray on which a user places a sheet by hand. Such an ink-jet recording apparatus also includes a manual feed conveyance path extending from the manual feed tray to the conveyance roller. When the motor is rotated in a first direction until the state of the communication among the plurality of ports becomes an image recording state in which recording is performed, the sheet is conveyed by a rotation of the conveyance roller in the forward conveying direction. Therefore, after the conveyance of the sheet, it is necessary to rotate the motor in a second direction opposite to the first direction, whereby the sheet is conveyed in the backward conveying direction in order to put the sheet at an appropriate position for the recording of the image.

However, when the state of the communication among the plurality of ports is switched to the image recording state in a case of a sheet having a certain size, an upstream edge of the sheet in the forward conveying direction may go over a downstream end of the manual feed conveyance path in the forward conveying direction. When the sheet having the certain size is then conveyed in the backward conveying direction, the sheet may not return into the manual feed conveyance path. In particular, where the ink-jet recording apparatus includes another conveyance path extending from a sheet supply tray other than the manual feed tray to a recording head, the sheet may be conveyed not to the manual feed conveyance path but to the another conveyance path when the sheet is conveyed in the backward conveying direction. In addition, the sheet may jam in the conveyance path at that time.

There is known an ink-jet recording apparatus including a rearward opening through which the sheet passes when a motor for a sheet conveyance is reversely rotated in order to operate a suction pump and a switching portion. However, this ink-jet recording apparatus is not suited for the backward conveyance of the sheet due to driving the switching portion. The sheet may be conveyed, due to driving the switching portion, until the upstream edge of the sheet may go over the manual feed conveyance path in the forward conveying direction. Therefore, the rearward opening cannot fully prevent an occurrence of a jam of the sheet, when the state of the communication among the ports is switched to the image recording state and then the sheet is conveyed in the backward conveying direction.

This invention has been developed to provide an ink jet recording apparatus configured to reduce the conveyance of the sheet from the manual feed tray due to the driving of the switching portion.

The object indicated above may be achieved according to the present invention which provides an ink-jet recording apparatus including: a manual feed tray on which a sheet is placed; a motor rotatable in a first direction and a second direction opposite to the first direction; a conveyance roller configured to be rotated in a forward direction by a transmission of a rotation of the motor in the first direction so that the sheet on the manual feed tray is supplied into a conveyance path and is conveyed in a conveying direction, the conveyance roller being configured to be rotated in a reverse direction opposite to the forward direction by a transmission of a rotation of the motor in the second direction; an encoder configured to detect a rotation of the conveyance roller; a recording head disposed downstream of the conveyance roller in the conveying direction and having a nozzle face on which a plurality of nozzles are formed, the recording head being configured to eject an ink to record an image on the sheet; a cap configured to be put into a first posture in which the cap covers the nozzle face and into a second posture in which the cap is away from the nozzle face; a suction pump configured to be driven by a transmission of the rotation of the motor in the second direction; a switching portion comprising a plurality of ports including at least a first port and a second port, wherein the switching portion is configured to switch a state of communication between the first port and the second port by a transmission of the rotation of the motor in the first direction, the first port being connected to a suction port of the suction pump, the second port communicating with an inside space of the cap; and a controller electrically connected to the motor and the encoder, wherein, when the controller receives an image recording command for the sheet placed on the manual feed tray in a state in which the cap is in the first posture, the controller is configured to rotate the motor in the first direction by a first rotation amount smaller than a complete switch rotation amount, the complete switch rotation amount being a rotation amount of the motor required to put the state of the communication into a first communication state, which is a state of the switching portion in which recording is performed, wherein the controller is configured to rotate the motor in the second direction by a second rotation amount equal to or less than the first rotation amount after the rotation of the motor in the first direction by the first rotation amount, and wherein the controller is configured to rotate the motor in the first direction by a difference rotation amount between the complete switch rotation amount and the first rotation amount so that the state of the communication is put into the first communication, after the rotation of the motor in the second direction by the second rotation amount.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which:

FIGS. 5A-5E are views of a port switching mechanism 59; wherein FIG. 5A is a front view of the port switching mechanism 59, FIG. 5B is a cross-sectional view taken along the line A-A in FIG. 5A and showing a lock state, FIG. 5C is a cross-sectional view taken along the line A-A in FIG. 5A and showing a BK empty suction state, FIG. 5D is a cross-sectional view taken along the line A-A in FIG. 5A and showing a CO empty suction state, and FIG. 5E is a cross-sectional view taken along the line A-A in FIG. 5A and showing a scanable state;

FIGS. 8A and 8B are perspective views of a gear switching mechanism 170, wherein FIG. 8A shows a first driving state and FIG. 8B shows a second driving state;

FIG. 11 is a table showing a relation between a rotational direction of a conveyance motor and a destination of a transmission of a rotational drive force; and FIG. 12 is a table showing a relation among a port switching mechanism, conveyance distance, and a sheet position.

DETAILED DESCRIPTION OF TUE PREFERRED EMBODIMENTS

Figure 1:
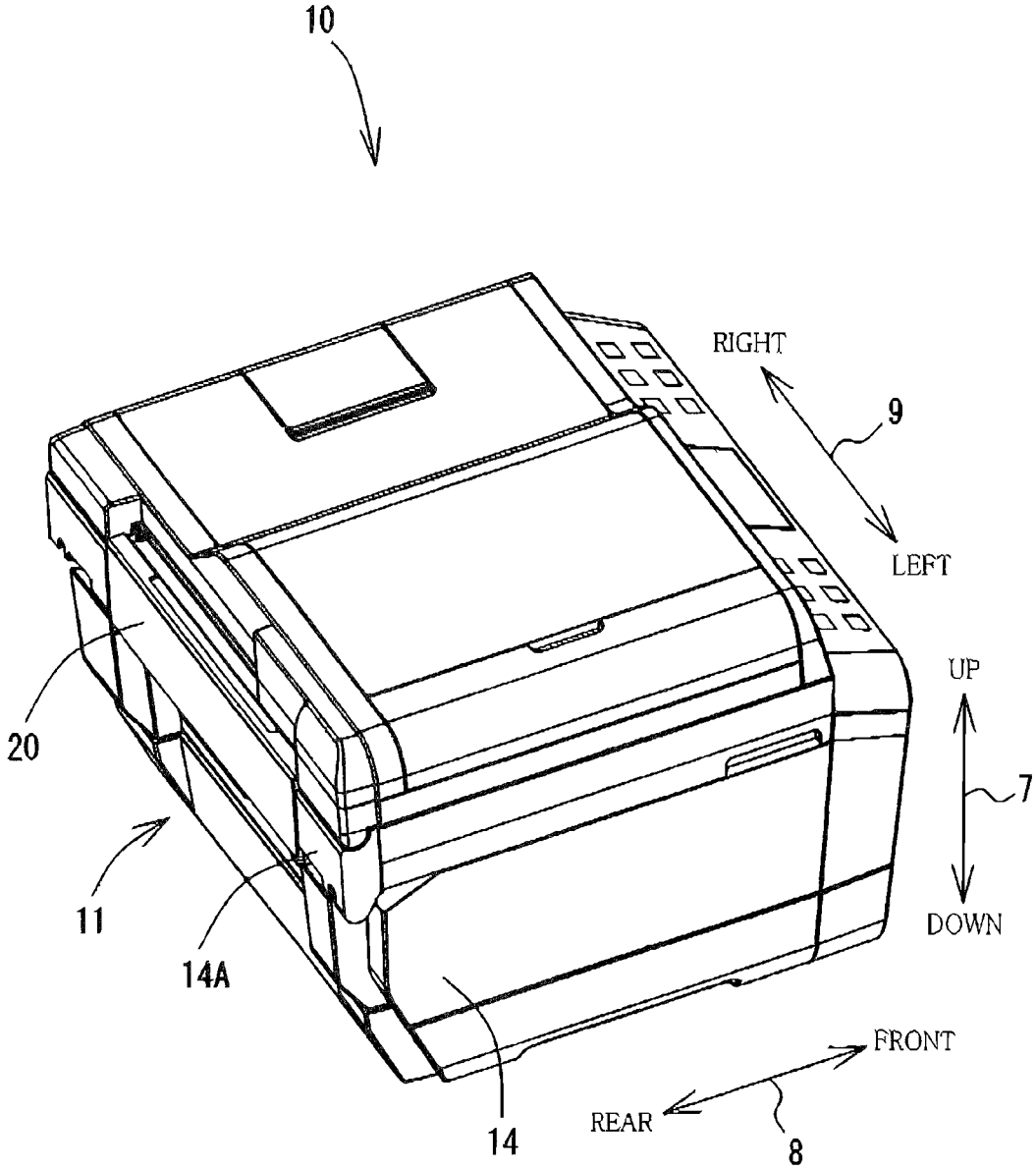
FIG. 1 is a perspective view of a multifunction peripheral 10 of an embodiment according to the present invention.

FIG. 1 shows a perspective view of an appearance of a multifunction peripheral 10 (an example of an ink-jet recording apparatus). In the following description, an up-down direction 7 is defined with reference to a state in which the multifunction peripheral 10 is operably placed, that is, a state shown in FIG. 1. A front-rear direction 8 is defined with reference to that a portion of the multifunction peripheral 10 in which an operation panel is disposed is a front portion. A left-right direction 9 is defined with reference to a view from a viewpoint in front of the multifunction peripheral 10. Incidentally, the left-right direction 9 is an example of the main scanning direction.

The multifunction peripheral 10 includes, in a lower portion thereof, a printer unit 11 of an ink-jet recording type. The multifunction peripheral 10 has a variety of functions, such as a facsimile function, a printer function, a scanner function, and a copy function. In this embodiment, the multifunction peripheral 10 has, as the printer function, an image recording function capable of recording an image only on one face of a sheet. However the multifunction peripheral 10 may have an image recording function capable of recording an image on both faces of the sheet.

Structure of Printer Unit 11

Figure 2:
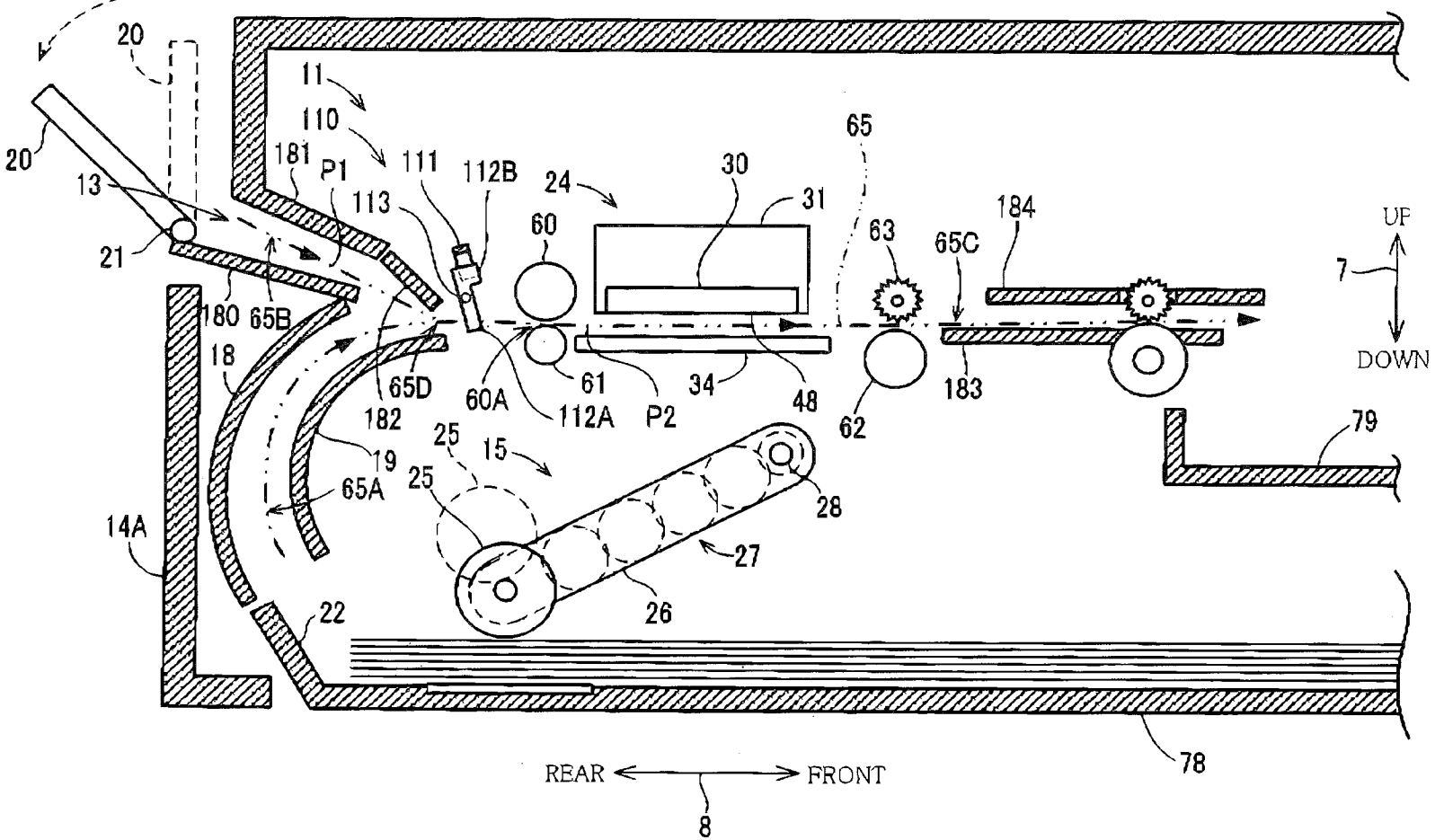
FIG. 2 is a schematic view of a printer unit 11.

As shown in FIG. 1 and FIG. 2, the printer unit 11 includes a casing 14 having an opening disposed at a front portion of the printer unit 11 and an opening at a rear portion of the printer unit 11. Components of the printer unit 11 are provided in the casing 14. An accommodation space is defined in such a manner as to extend from the opening (not shown) at the front portion of the printer unit 11 to an inside of the casing 14. A sheet supply cassette 78 is provided in the accommodation room. The sheet supply cassette 78 is inserted into and pulled from the inside of the casing 14 in the front-rear direction 8 through the opening at the front portion of the printer unit 11. The sheet supply cassette 78 accommodates recording sheets (constituting an example of a sheet) of a variety of sizes. In this embodiment, the multifunction peripheral 10 has the sheet supply cassette 78 as a single sheet supply cassette, however the multifunction peripheral 10 may have a plurality of sheet supply cassettes.

A manual feed tray 20 configured to be opened and closed is disposed on a rear face 14A of the printer unit 11. As shown by an arrow of a broken line in FIG. 2, the manual feed tray 20 is opened and closed by being pivoted around a shaft 21 as a pivot axis. FIG. 1 shows a close state in which the manual feed tray 20 is closed. FIG. 2 shows an open state of the manual feed tray 20 in a solid line and the close state of the manual feed tray 20 in a broken line. The recording sheet of a variety of sizes can be placed on the manual feed tray 20 in the open state. A rear face opening 13 is provided at around a proximal edge (a lower edge) of the manual feed tray 20 on the rear face 14A of the printer unit 11. The recording sheet is placed on a sheet placed face of the manual feed tray 20 by a user of the multifunction peripheral 10. Then, the recording sheets are inserted from the rear face opening 13 into the inside of the casing 14 by a user of the multifunction peripheral 10.

The structure of the printer unit 11 is further described with reference to FIG. 2. In FIG. 2, a forward portion of the sheet supply cassette 78 (a right side on the drawing sheet of FIG. 2) is omitted. The printer unit 11 further includes a sheet supplying unit 15 and a recording unit 24. The sheet supplying unit 15 picks up the recording sheet from the sheet supply cassette 78 and supplies the recording sheet. The recording unit 24 ejects droplets of an ink onto the recording sheet supplied by the sheet supplying unit 15 so as to form an image on the recording sheet.

Conveyance Path 65

As shown in FIG. 2, there is formed a conveyance path 65 inside the printer unit 11. The conveyance path 65 extends from both of the sheet supply cassette 78 and the manual feed tray 20 to a discharged sheet receiver 79 via the recording unit 24. The conveyance path 65 is divided into three portions, specifically, a curved passage 65A, a conveyance passage 65B, and a discharge passage 65C. The curved passage 65A is formed between a rear edge of the sheet supply cassette 78 and the recording unit 24. The conveyance passage 65B is formed between a front edge of the manual feed tray 20 and a junction point 65D at which the conveyance passage 65B joins with the curved passage 65A. The discharge passage 65C is formed between the recording unit 24 and the discharged sheet receiver 79. The discharged sheet receiver 79 may be integrally formed on the sheet supply cassette 78, or may be fixed to a frame of the printer unit 11.

The curved passage 65A is a curved passage extending from around an upper edge of an inclined separation plate 22 provided in the sheet supply cassette 78 to the recording unit 24. The recording sheet is conveyed rearward from the sheet supply cassette 78. The recording sheet is U-turned by the curved passage 65A at a rear portion of the multifunction peripheral 10 in a conveyance from a rear lower portion of the multifunction peripheral 10 to a rear upper portion of the multifunction peripheral 10. Then, the recording sheet is conveyed forward. The curved passage 65A is defined by an outer guide member 18 and an inner guide member 19 that face to each other with a predetermined space provided between the guide members 18 and 19. Each of the outer guide member 18 and the inner guide member 19 extends in the left-right direction 9 (a direction perpendicular to the drawing sheet of FIG. 2). Additionally, as described later in detail, each of a first lower guide member 180, a first upper guide member 181, a second upper guide member 182, a second lower guide member 183, and a third upper guide member 184 also extends in the left-right direction 9.

The conveyance passage 65B is a straight passage extending from the rear face opening 13 of the printer unit 11 to the junction point 65D at which the conveyance passage 65B joins with the curved passage 65A. The recording sheet is inserted to come into contact with a nip position 60A located between a first conveyance roller 60 and a pinch roller 61 through the rear face opening 13 and the conveyance passage 65B. The conveyance passage 65B is defined by the first lower guide member 180 and the first upper guide member 181 that face to each other with a predetermined space provided between the guide members 180 and 181. The second upper guide member 182 is disposed downstream of the first upper guide member 181 in a forward conveying direction. Here, the forward conveying direction represents a direction in which the recording sheet is conveyed in the conveyance path 65, and is indicated by an alternate long and two short dashes line with arrows in FIG. 2. The second upper guide member 182 extends from a front edge of the first upper guide member 181 to around an upper area of the junction point 65D, and the second upper guide member 182 guides the recording sheet inserted from the manual feed tray 20 to the nip position 60A through the junction point 65D. Incidentally, in the embodiment, the first lower guide member 180 and the outer guide member 18 are formed separately, but may be integrally formed as a single piece. Additionally, the first upper guide member 181 and the second upper guide member 182 are formed separately, but may be integrally formed as a single piece.

The discharge passage 65C are defined by the second lower guide member 183 and the third upper guide member 184 that are disposed downstream of the recording unit 24 in the forward conveying direction. After an image had been recorded on the recording sheet and the recording sheet has been conveyed by a second conveyance roller 62, the second lower guide member 183 guides the recording sheet in the forward conveying direction while supporting a back face of the recording sheet. The third upper guide member 184 is disposed at a position higher than the second lower guide member 183. The second lower guide member 183 and the third upper guide member 184 are disposed to face to each other with a predetermined space provided between the guide members 183 and 184.

Sheet Supplying Unit 15

The sheet supplying unit 15 is configured to convey the recording sheet accommodated in the sheet supply cassette 78 to the curved passage 65A. The sheet supplying unit 15 includes a sheet supply roller 25, a sheet supply arm 26, and a sheet-supply-drive transmitting mechanism 27. The sheet supply roller 25 is disposed above the sheet supply cassette 78. The sheet supply roller 25 is configured to pick up the recording sheet accommodated in the sheet supply cassette 78 and supply the recording sheet to the curved passage 65A. The sheet supply roller 25 is rotatably supported at a distal end of the sheet supply arm 26 by a shaft. A rotational force of a conveyance motor 76 is transmitted to the sheet supply roller 25 via both of a drive transmitting mechanism 140 (FIG. 7) and the sheet-supply-drive transmitting mechanism 27, whereby the sheet supply roller 25 is rotationally driven. The sheet-supply-drive transmitting mechanism 27 is rotatably supported by the sheet supply arm 26, and is constituted by a plurality of gears aligning approximately along an extending direction of the sheet supply arm 26. The sheet supply roller 25 pivots around a shaft 28, and is pressedly contactable with a top face of the recording sheet accommodated in the sheet supply cassette 78.

Registration Sensor 110

A registration sensor 110 is provided in the curved passage 65A. The registration sensor 110 detects a position of a leading edge of the recording sheet that is supplied from the sheet supply cassette 78 and conveyed through the curved passage 65A. And the registration sensor 110 also detects the position of the leading edge of the recording sheet that is supplied from the manual feed tray 20 and conveyed through the conveyance passage 65B. The registration sensor 110 includes, for example, a rotational body 112 and a light sensor 111. The rotational body 112 has detected portions 112A, 112B. The light sensor 111 is, for example, a photo-interrupter, and has a light emitting element (for example, a luminescence diode) and a light receiving element (for example, a phototransistor) receiving a light emitted from the light emitting element. The rotational body 112 is provided in such a manner as to rotate around a support shaft 113. The detected portion 112A protrudes from the support shaft 113 into the curved passage 65A. Where an external force is not applied to the rotational body 112, the detected portion 112B interrupts a light path extending from the light emitting element of the light sensor 111 to the light receiving element of the light sensor 111, thereby blocking the light travels through the light path.

Recording Unit 24

Figure 3:
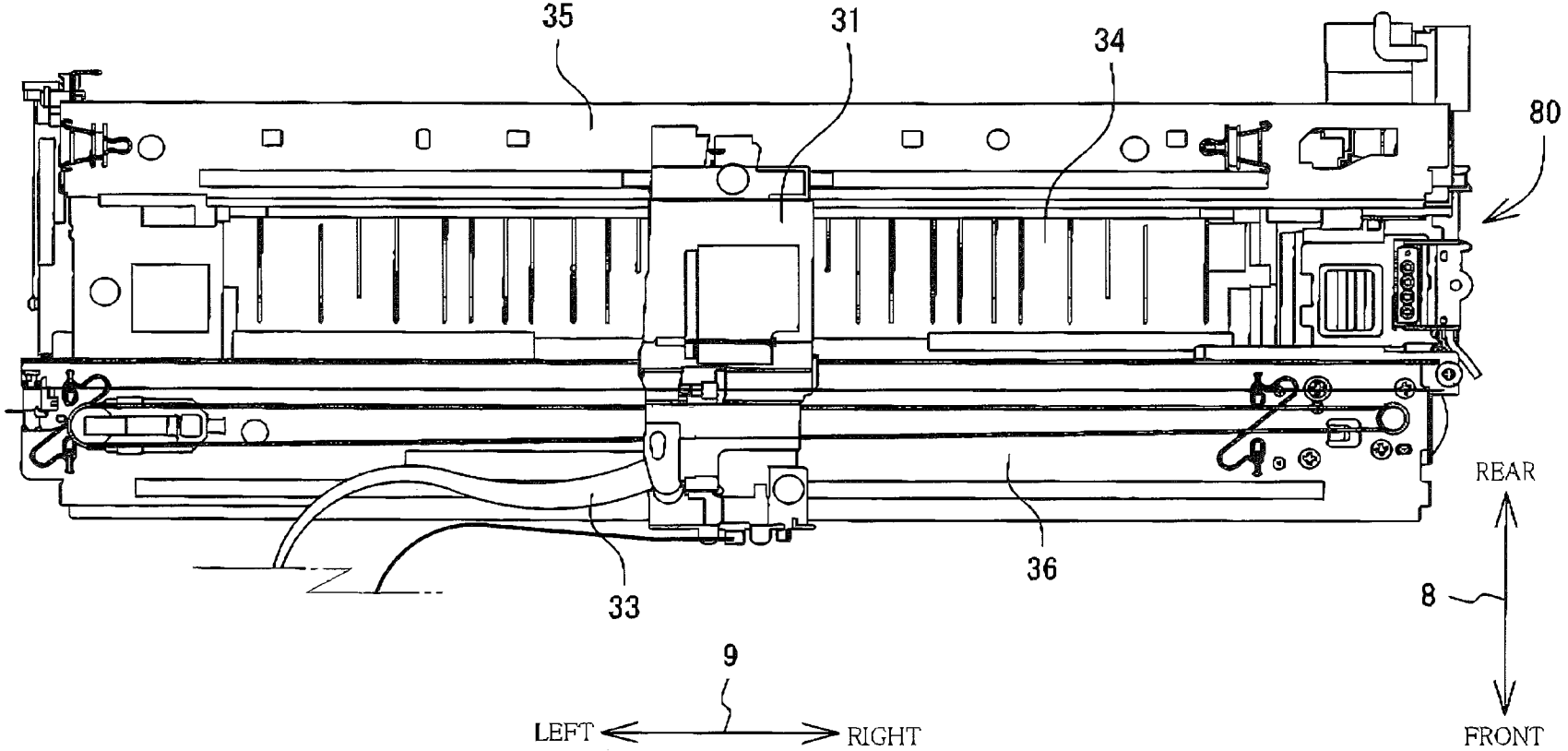
FIG. 3 is a plain view showing a peripheral area of a recording unit 24.

As shown in FIG. 2, the recording unit 24 is disposed above the sheet supply cassette 78. As shown in FIGS. 2 and 3, the recording unit 24 includes a carriage 31 having a recording head 30 and configured to reciprocate in the left-right direction 9. The recording head 30 is supplied with inks of respective colors, specifically, cyan (C), magenta (M), yellow (Y), and black (Bk), from respective ink cartridges (not shown) through respective ink tubes 33. The carriage 31 reciprocates on guide rails 35, 36 each extending in the main scanning direction. Thus, the recording head 30 scans with respect to the recording sheet, and an image recording is performed on the recording sheet conveyed on a platen 34, which is disposed under the recording unit 24.

As shown in FIG. 2, the recording head 30 is exposed at a bottom portion of the carriage 31. A nozzle face 48 (an example of a nozzle face) of the recording head 30 is provided with a plurality of nozzles (not shown), which constitutes an example of a plurality of nozzles. The nozzles are provided for C, M, Y, Bk colors. The inks of the colors are ejected from the nozzles as tiny ink droplets.

The first conveyance roller 60 (an example of a conveyance roller) and the pinch roller 61 are disposed between an upper end of the curved passage 65A and the recording unit 24. The first conveyance roller 60 and the pinch roller 61 constitute a pair. The pinch roller 61 is disposed under the first conveyance roller 60, and is in pressure contact with a roller face of the first conveyance roller 60 by an elastic member (not shown), such as a spring. The first conveyance roller 60 and the pinch roller 61 nip the recording sheet conveyed through the curved passage 65A and the conveyance passage 65B, and than send the paper sheet to the platen 34. Additionally, the second conveyance roller 62 and a spur roller 63 are disposed between the recording unit 24 and a rear end of the discharge passage 65C. The second conveyance roller 62 and the spur roller 63 constitute a pair. The second conveyance roller 62 and the spur roller 63 nip the recording sheet on which an image has been recorded, and then convey the recording sheet in the forward conveying direction (toward the discharged sheet receiver 79).

Figure 7:
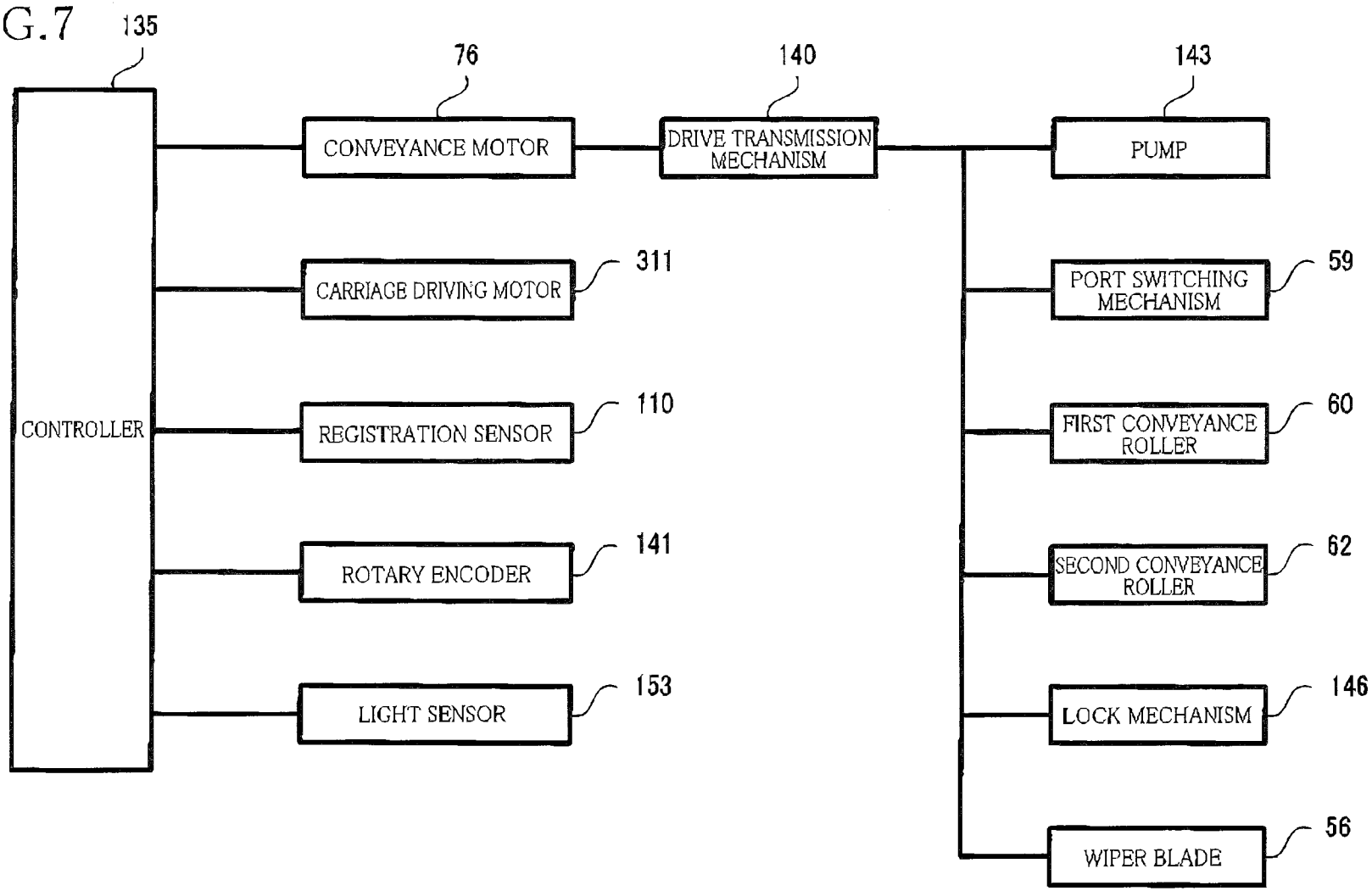
FIG. 7 is a block diagram showing functional connections between a controller 135 and components.

The first conveyance roller 60 and the second conveyance roller 62 are rotated by a rotational drive force which is transmitted from the conveyance motor 76 (FIG. 7) via the drive transmitting mechanism 140 (FIG. 7). The first conveyance roller 60 and the second conveyance roller 62 are intermittently driven when an image is recorded on the recording sheet. That is, the image is recorded while the recording sheet is intermittently conveyed by a predetermined linefeed width.

An optical rotary encoder 141 (FIG. 7) as an example of an encoder is provided in a peripheral area of the first conveyance roller 60. The rotary encoder 141 detects a rotation of the first conveyance roller 60, and sends, to a controller 135, a signal based on a rotation amount of the first conveyance roller 60.

Maintenance Unit 80

As shown in FIG. 3, a maintenance unit 80 is disposed in one of both areas outside the platen 34 in the left-right direction 9 through which the recording sheet is not conveyed, that is, disposed in an escape position in a reciprocating area of the recording unit 24. The maintenance unit 80 includes a purge mechanism 44, a waste liquid tank 142 (FIG. 6), and so on.

The purge mechanism 44 suctions an air bubble and a foreign matter with the inks so as to remove the air bubble and the foreign matter from the nozzles and so on of the recording head 30. As shown in FIG. 4, the purge mechanism 44 includes a cap 46, a pump 143 (FIG. 6) as an example of a suction pump, a lift-up mechanism 55, the waste liquid tank 142, a wiper blade 56 as an example of a wiper, and a lock mechanism 146 (FIG. 7). The cap 46 is configured to cover or cap the nozzles of the recording head 30. The pump 143 is connected to the cap 46 and performs suction. The lift-up mechanism 55 moves the cap 46 to come close to and separate away from the recording head 30. The wiper blade 56 wipes out the nozzle face 48. The lock mechanism 146 locks the lift-up mechanism 55 in a posture shown in FIG. 4B.

The cap 46 is made of rubber. The cap 46 is tightly attached to the nozzle face 48 (see FIG. 2) by the lift-up mechanism 55 so as to surround the nozzles and form closed spaces between the cap 46 and the nozzle face 48. An inside of the cap 46 is divided into two spaces one of which is for the color inks (CMY) and the other of which is for the black ink (Bk). That is, the space corresponding to the color inks and the space corresponding to the black ink are formed between the cap 46 and the nozzle face 48. Hereinafter, a part of the cap 46 corresponding to the color inks is referred to as a CO cap 144, and a part of the cap 46 corresponding to the black ink is referred to as a BK cap 145. A suction port is provided at a part of a bottom portion of each of the spaces for the CO cap 144 and the BK cap 145. The suction port is connected through a tube or the like to a port of the port switching mechanism 59 described later. Details of the port switching mechanism 59 are described later.

The pump 143 is a rotary type tube pump. In the present embodiment, the pump 143 includes a casing having an inner wall face and a roller that rolls along the inner wall face. A pump tube 82 is disposed between the roller and the inner wall face, and the roller is driven. Thus, the pump tube 82 is squeezed, and the ink in the pump tube 82 is extracted to the waste liquid tank 142. The pump 143 is driven by the drive force of the conveyance motor 76 which is transmitted through the drive transmitting mechanism 140.

Figure 4A:
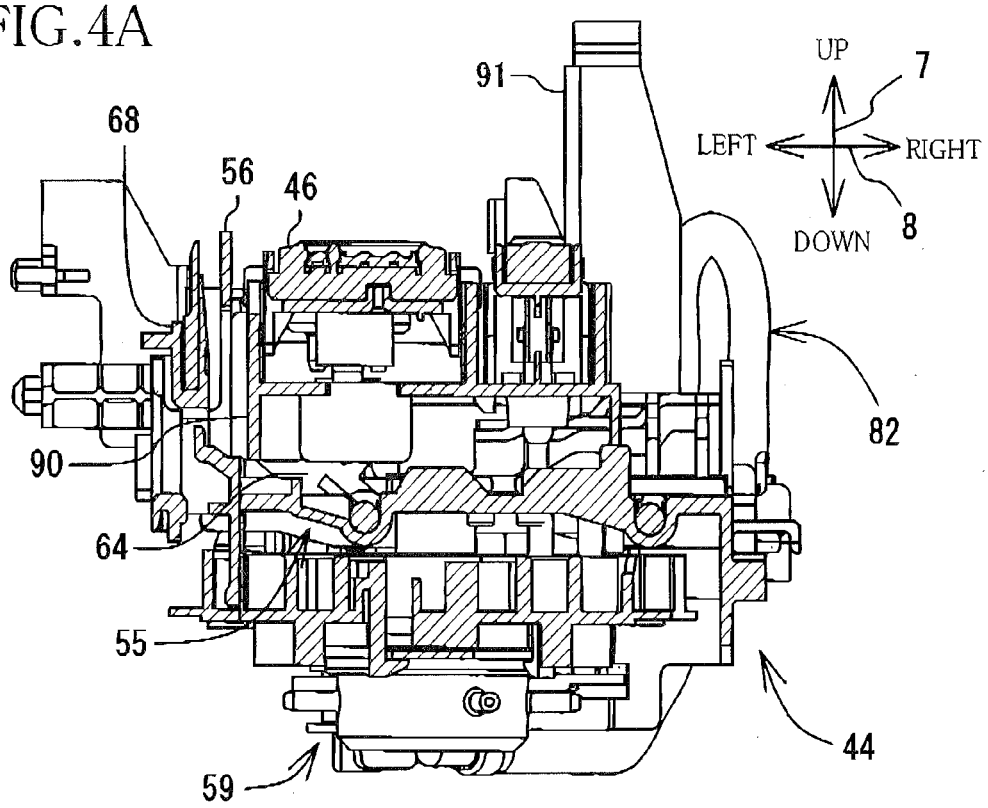
FIGS. 4A and 4B are front views of a maintenance unit 80.
Figure 4B:
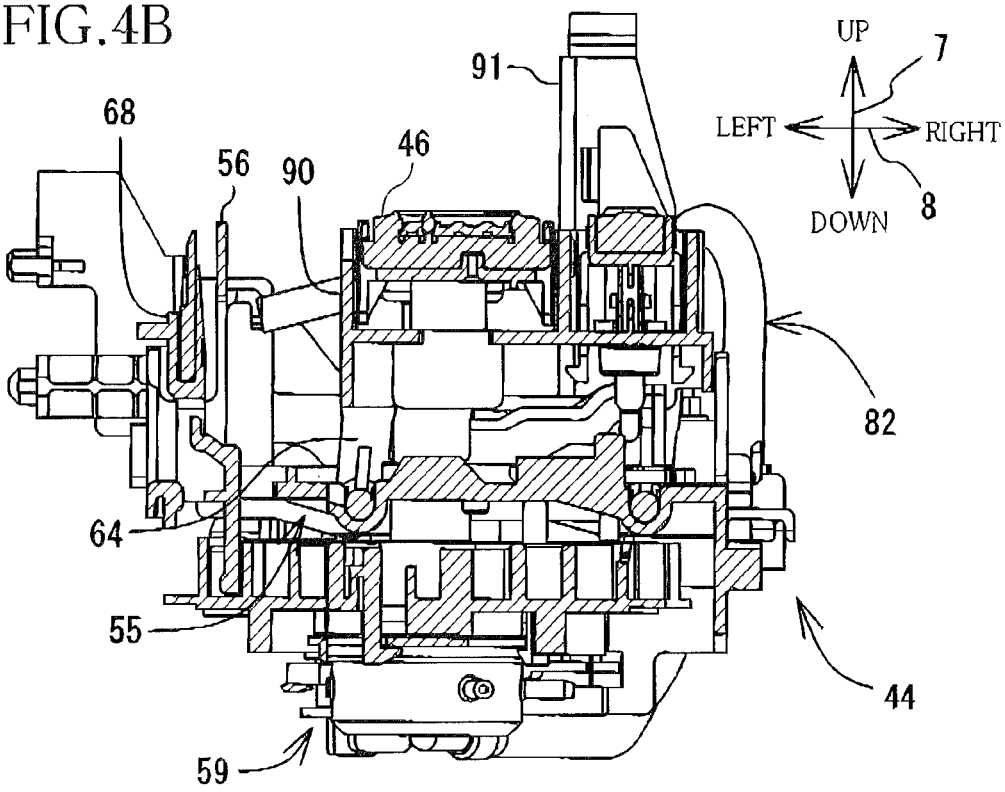

As shown in FIG. 4A, the lift-up mechanism 55 includes a pair of links 64 separately provided in the left-right direction 8. Each of the links 64 has the same length. The links 64 pivot to move a holder 90 in parallel in the left-right direction 8, whereby the holder 90 moves between a waiting position and an attaching position. The holder 90 located at the waiting position is shown in FIG. 4A, and the holder 90 located at the attaching position is shown in FIG. 4B. The holder 90 includes a pushed lever 91 protruding upward. As shown in FIGS. 4A and 4B, the carriage 31 pushes the pushed lever 91 rightward, whereby the holder 90 is moved to the attaching position. When the holder 90 is moved to the attaching position, the cap 46 is tightly attached to a periphery portion of the nozzles of the recording head 30, that is, the cap 46 is put into a first posture. Additionally, when the holder 90 is moved to the waiting position, the cap 46 is separated away from the recording head 30, that is, the cap 46 is put into a second posture. The carriage 31 is moved by a carriage driving motor 311 (an example of a drive source). It is noted that a structure for changing a posture of the cap 46 is not limited to the above lift-up mechanism 55 as long as the cap 46 is put into the first posture and the second posture.

The lock mechanism 146 is configured to lock a posture of the lift-up mechanism 55 in a state shown in FIG. 4B. That is, the cap 46 is locked in a state in which the cap 46 is tightly attached to a periphery portion of the recording head 30. This is performed in order to prevent a change of the posture of the lift-up mechanism 55 due to a release of the pushing by the carriage 31 against the pushed lever 91. The lock mechanism 146 includes a restraining member (not shown) configured to change in a posture thereof between a posture (a lock posture) in which the restraining member restrains the pivoting of the links 64 and a posture (a lock release posture) in which the restraining member does not restrain the pivoting of the links 64. The restraining member changes in the posture thereof between the two postures by the drive force of the conveyance motor 76 which is transmitted through the drive transmitting mechanism 140.

The wiper blade 56 is fitted in a wiper holder 68, and is provided in such a manner as to move out of and move in the wiper holder 68. The wiper blade 56 is made of rubber. A length of the wiper blade 56 in a direction perpendicular to a drawing sheet of FIG. 4, that is, in the front-rear direction 8 corresponds to a length of the nozzle face 48 in the direction. The wiper blade 56 moves out of the wiper holder 68 and comes into contact with the nozzle face 48. When the carriage 31 slides in a state in which the wiper blade 56 is in contact with a bottom face of the recording head 30, the wiper blade 56 wipes out the inks on the nozzle face 48. Such a wipe-out of the inks is referred to as a "wiping". The wiper blade 56 moves out of and moves in the wiper holder 68 by the drive force of the conveyance motor 76 which is transmitted through the drive transmitting mechanism 140.

Drive Transmitting Mechanism 140

As shown in FIG. 7, the drive transmitting mechanism 140 is constituted by planet pinions and so on, and is configured to transmit the rotational drive force of the conveyance motor 76 to the first conveyance roller 60, the second conveyance roller 62, the lock mechanism 146, the wiper blade 56, the sheet supply roller 25, and the port switching mechanism 59 described later. The drive transmitting mechanism 140 includes the gear switching mechanism 170 configured to switch the transmission of the rotational drive force of the conveyance motor 76.

The gear switching mechanism 170 shown in FIG. 8 is disposed in a right side of the platen 34 and under a pathway of the carriage 31. The gear switching mechanism 170 includes a switch gear 171, four passive gears 172A-172D, a push member 175, and a retainer 173. The switch gear 171 is rotationally driven by the conveyance motor 76. Each of the four passive gears 172A-172D is meshable with the switch gear 171. The push member 175 is coaxially provided with the switch gear 171. The retainer 173 is configured to retain the switch gear 171.

The switch gear 171 is supported by a supporting shaft 174. The switch gear 171 is rotatable around the supporting shaft 174 and movable along an axis direction (the left-right direction 9) of the supporting shaft 174. The push member 175 is slidably supported by the supporting shaft 174 in a right side of the switch gear 171. A switch lever 176 of the push member 175 extends upward through the retainer 173 to the pathway of the carriage 31. The switch gear 171 and the push member 175 are pushed rightward by a spring.

Figure 8A:
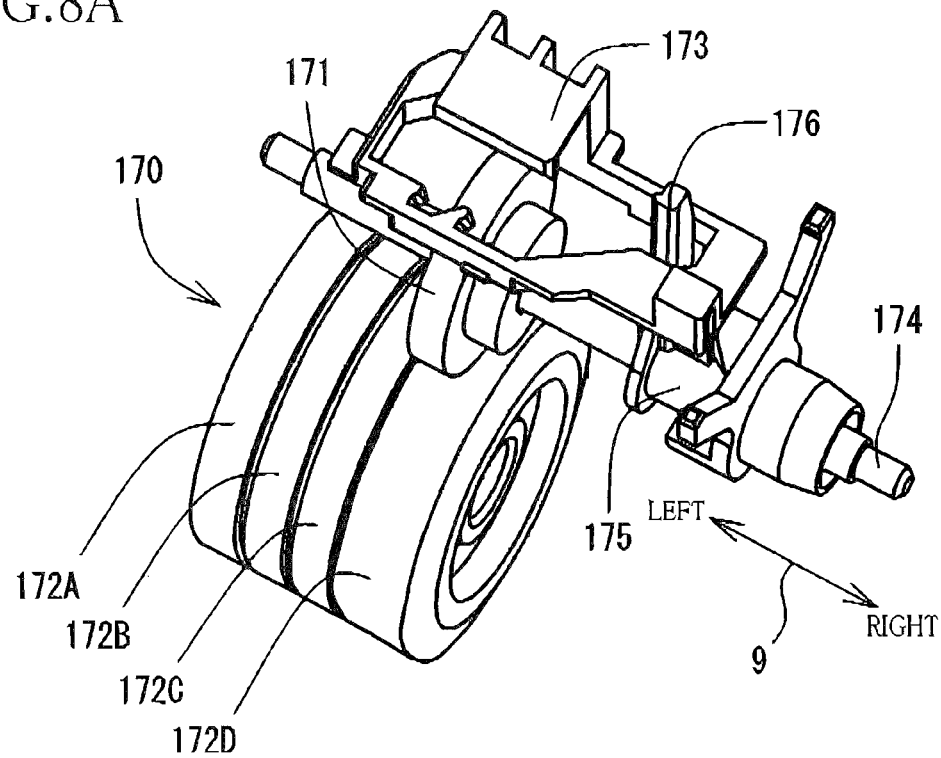
Figure 8B:
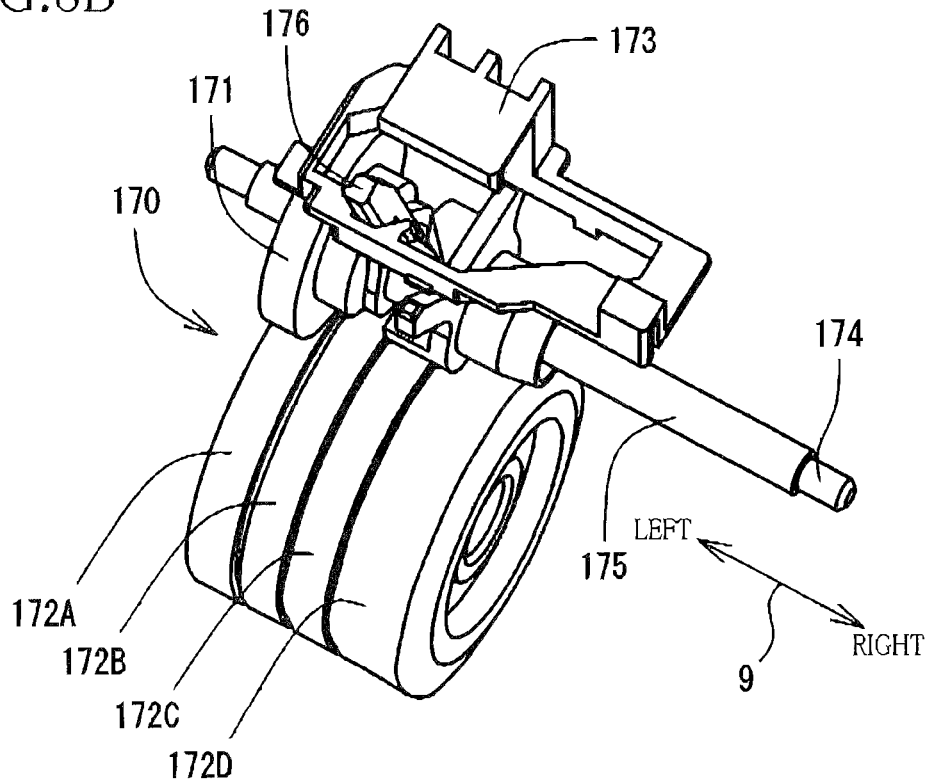

The passive gears 172A-172D are coaxially rotatably supported below the supporting shaft 174 along the left-right direction 9. When the carriage 31 moves leftward, the switch lever 176 is pushed and slid leftward by the carriage 31. The switch lever 176 is retained by the retainer 173 at positions different from each other according to positions to which the switch lever 176 slides. For example, as shown in FIG. 8A, when a retaining of the switch lever 176 is released and the push member 175 is at the most right position in a movable range thereof, the switch gear 171 meshes with the passive gear 172D that is the most right one of the passive gears 172A-172D. Hereinafter, this state is referred to as a first driving state. Also, as shown in FIG. 8B, when the switch lever 176 is at the most left position in the movable range, the switch gear 171 is pushed leftward by the push member 175 and then meshes with the passive gear 172A. Hereinafter, this state is referred to as a second driving state.

The passive gears 172A-172D are configured to transmit the rotational drive force transmitted from the conveyance motor 76 via the switch gear 171, to different mechanisms. Details of drive transmissions in both of the first driving state and the second driving state are shown in FIG. 11. It is noted that drive transmissions regarding the passive gears 172B and 172C are omitted.

As shown in FIG. 11, when the conveyance motor 76 rotates in a first direction in the first driving state, the rotational drive force of the conveyance motor 76 rotates each of the first conveyance roller 60 and the second conveyance roller 62 in a corresponding direction in which the recording sheet is conveyed in the forward conveying direction. When the conveyance motor 76 rotates in a second direction in the first driving state, the rotational drive force of the conveyance motor 76 rotates each of the first conveyance roller 60 and the second conveyance roller 62 in a corresponding direction in which the recording sheet is conveyed in a backward conveying direction opposite to the forward conveying direction.

Only when the conveyance motor 76 rotates in the first direction, the rotational drive force of the conveyance motor 76 is transmitted to the lock mechanism 146, the wiper blade 56, and the port switching mechanism 59. The restraining member of the lock mechanism 146 alternately changes in the posture thereof between the lock posture and the lock release posture by the rotation of the conveyance motor 76 in the first direction. The wiper blade 56 periodically moves out of and moves in the wiper holder 68 by the rotation of the conveyance motor 76 in the first direction. The port switching mechanism 59 periodically switches the state of the communication among the ports by the rotation of the conveyance motor 76 in the first direction. Details are described later. In addition, the pump 143 is driven by the rotation of the conveyance motor 76 in the second direction.

In the second driving state, only when the conveyance motor 76 rotates in the first direction, the rotational drive force of the conveyance motor 76 is transmitted to the first conveyance roller 60 and the second conveyance roller 62. The rotational drive force of the conveyance motor 76 in the first direction rotates the first conveyance roller 60 and the second conveyance roller 62 in the respective directions in each of which the recording sheet is conveyed in the forward conveying direction, that is, to the discharged sheet receiver 79.

In addition, in the second driving state, only when the conveyance motor 76 rotates in the second direction, the rotational drive force of the conveyance motor 76 is transmitted to the sheet supply roller 25. The rotational drive force of the conveyance motor 76 in the second direction rotates the sheet supply roller 25 in a direction in which the recording sheet is supplied to the conveyance path 65.

Port Switching Mechanism 59

The port switching mechanism 59 (an example of a switching portion) shown in FIGS. 4 and 5, includes a hollow cylinder 147, and a rotating body 148 having an almost column shape and being rotatable inside the cylinder 147. The cylinder 147 has a plurality of ports through each of which an inside space and an outside space of the cylinder 147 are communicated with each other. Ribs 149 made of rubber, and grooves 150 are formed on an outer surface of the rotating body 148 in a predetermined pattern. The ribs 149 are in contact with an inner surface of the cylinder 147, and slides on the inner surface of the cylinder 147 by a rotation of the rotating body 148. There is a clearance between the inner surface of the cylinder 147 and the outer surface of the rotating body 148 at a portion of the outer surface of the rotating body 148 in which the ribs 149 are not formed. The plurality of ports communicate with each other through the clearance inside the port switching mechanism 59. When locations of the ribs 149 and the grooves 150 relative to each of the ports change by the rotation of the rotating body 148, the state of the communication among the ports is changed.

Figure 5B:
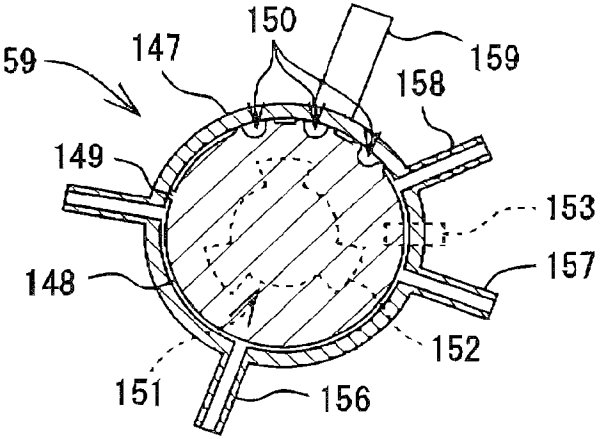

As indicated by a broken line in FIG. 5B, a detected member 151 is provided on one of end portions of the rotating body 148. The detected member 151 rotates together with the rotating body 148. The detected member 151 has a plurality of protruding portions 152 each protruding outward in a radial direction. Each of these protruding portions 152 is disposed in a corresponding one of positions different in a rotational phase of a rotating body 148, and the protruding portions 152 are disposed away from each other by respective predetermined rotation angles. In addition, a light sensor 153 (an example of a detector) is disposed at a position facing to the outer surface of the rotation body 148. The light sensor 153 outputs an electric signal indicating "ON", when the light sensor 153 faces to the protruding portions 152. In contrast, the light sensor 153 outputs an electric signal indicating "OFF", when the light sensor 153 does not face to the protruding portions 152. Accordingly, a rotational phase of the rotating body 148 is obtained based on a cycle of the output (ON/OFF) of the light sensor 153 between ON and OFF.

A CO communication port 154 and a BK communication port 155 are formed on an outer surface of one of two cylindrical portions which would be formed by bisecting the cylinder 147 perpendicular to an axis of the cylinder 147. A CO suction port 156, a BK suction port 157, and a communication port 158 are formed on an outer surface of the other of the two cylindrical portions. It is noted that the one of the two cylindrical portions is positioned above the other of the two cylindrical portions. Additionally, a pump connection port 159 is formed on an end face of the other of the two cylindrical portions. The rib 149 formed along a circumferential direction of the rotating body 148 insulates the two ports of the one of the two cylindrical portions and the three ports of the other of the two cylindrical portions from each other. Hereinafter, a portion of the port switching mechanism 59 as the one of the two cylindrical portions is referred to as an upper switching portion 160, and a portion of the port switching mechanism 59 as the other of the two cylindrical portions is referred to as a lower switching portion 161.

Air holes 162 passing through the cylinder 147 are formed in a portion of the cylinder 147 nearer to an end face of the upper switching portion 160 than the CO communication port 154 and the BK communication port 155. The upper switching portion 160 is configured to bring each of the CO communication port 154 and the BK communication port 155 to communicate with the air holes 162 according to the rotational phase the rotating body 148.

Figure 6:
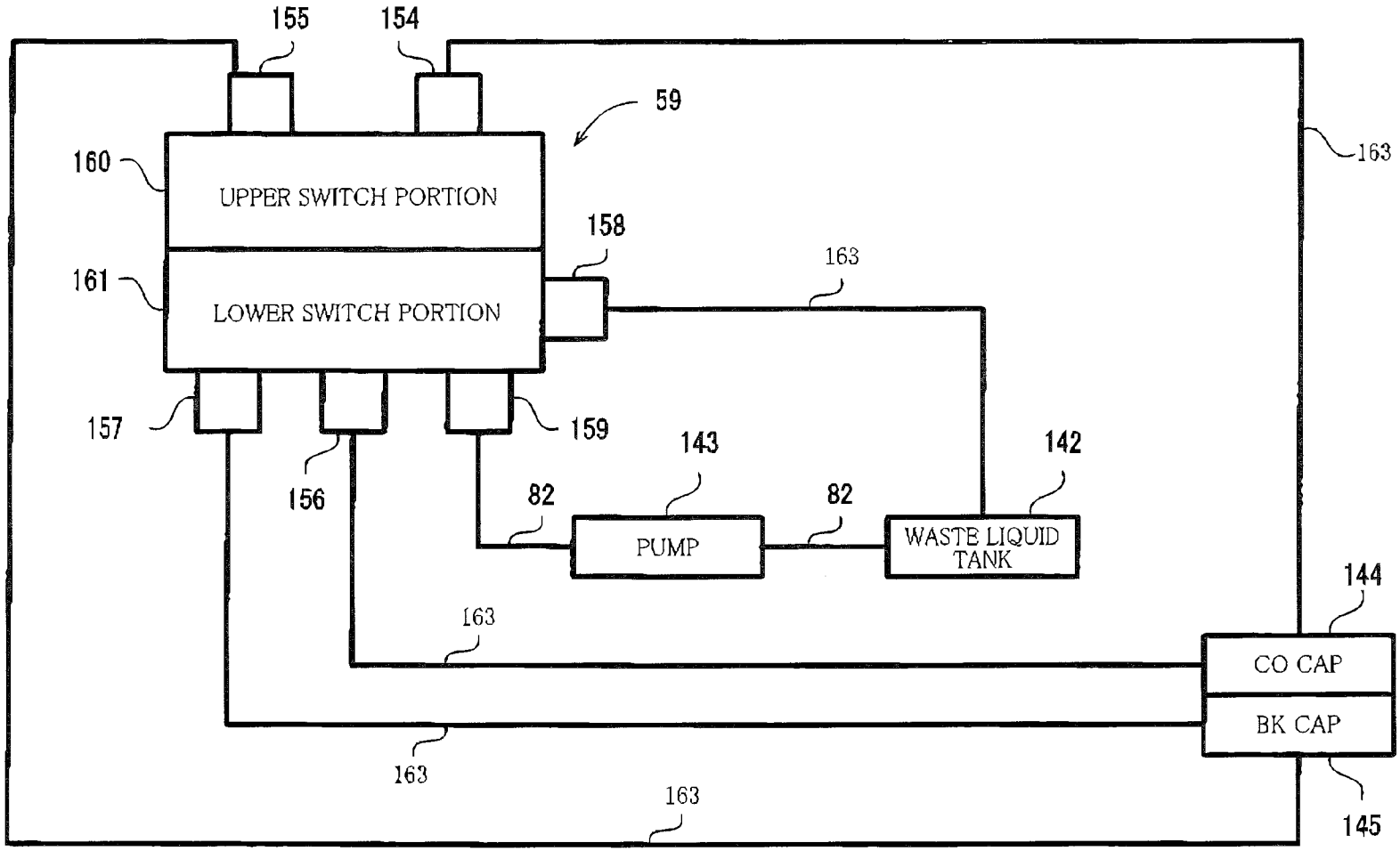
FIG. 6 is a block diagram showing a connection among ports in the port switching mechanism 59.

As shown in FIG. 6, the CO communication port 154 and the CO suction port 156 communicate with an inside space of the CO cap 144 through tubes 163. The BK communication port 155 and the BK suction port 157 communicate with an inside space of the BK cap 145 through tubes 163. The pump connection port 159 communicates with the waste liquid tank 142 through the pump 143. The waste liquid tank 142 also communicates with the communication port 158.

Followings are descriptions regarding suctioning the inks. Suctioning the color inks (C, M, Y) from the nozzles is performed in a state in which a communication between the CO communication port 154 and the air hole 162 is shut off by the upper switching portion 160, and in which the CO suction port 156 and the pump connection port 159 communicate with each other by the lower switching portion 161. In this state, when the conveyance motor 76 is rotated in the second direction, the pump 143 is driven and a pressure of the inside space of the CO cap 144 becomes negative. Therefore, the inks are suctioned from the nozzles of the recording head 30 to the pump 143. The suctioned inks are delivered to the waste liquid tank 142. Suctioning the black ink (Bk) from the nozzles is performed in a state in which a communication between the BK communication port 155 and the air hole 162 is shut off by the upper switching portion 160, and in which the BK suction port 157 and the pump connection port 159 communicate with each other by the lower switching portion 161. Since suctioning the black ink is performed in the same manner as suctioning the color inks (C, M, Y), a detailed description is omitted.

Controller 135

The controller 135 is configured to control an overall operation of the multifunction peripheral 10. The controller 135 is constituted as a microcomputer mainly including a CPU, a ROM, a RAM, an EEPROM, and an ASIC (all not shown).

The ROM stores a program by which the CPU controls a variety of operations of the multifunction peripheral 10, and a program for discriminating a state which is described later. The RAM is used as a memory area for temporarily storing data, commands, and so on which are used when the CPU performs the above program. The RAM is also used as a work, area for a data processing. The EEPROM stores a setting, a flag, and so on that must be stored after a power-off.

As shown in FIG. 7, the ASIC is connected to the conveyance motor 76, the carriage driving motor 311, the rotary encoder 141, the registration sensor 110, the light sensor 153, and so on. The controller 135 controls a rotation of the conveyance motor 76 and a rotation of the carriage driving motor 311 via the ASIC. The controller 135 also receives signals from the rotary encoder 141 and the light sensor 153.

The controller 135 calculates the rotation amount of the first conveyance roller 60 on the basis of the number of pulse signals inputted from the rotary encoder 141. The controller 135 corrects a remaining rotation amount on the basis of the calculated rotation amount. The remaining rotation amount is a rotation amount of the conveyance motor 76 which is required to convey the recording sheet to a target position.

The light sensor 153 outputs an analog electric signal (a voltage signal or a current signal) having a magnitude according to an intensity of the light received by the light receiving element. The outputted signal is inputted into the controller 135, and the controller 135 determines whether an electric level (a voltage value or a current value) is equal to or more than a predetermined value. When the outputted signal has the electric level equal to or more than the predetermined value, the outputted signal is determined as a HIGH level signal. When the outputted signal has the electric level less than the predetermined value, the outputted signal is determined as a LOW level signal. Similarly, the controller 135 determines on the basis of a threshold whether a signal from the light receiving element of the registration sensor 110 is the HIGH level signal or the LOW level signal.

The controller 135 also stores a profile in which the number of pulse signals inputted from the rotary encoder 141 and a state of the port switching mechanism 59 are associated with each other. The state of the port switching mechanism 59 may be determined based on the signal inputted from the light sensor 153 and the number of the pulse signals inputted from the rotary encoder 141.

Switch from Lock State to Scanable State

FIG. 5B shows the rotational phase of the rotating body 148 in a state (hereinafter a state is referred to as a lock state) in which the lift-up mechanism 55 is locked by the lock mechanism 146. In the lock state, the CO suction port 156, the BK suction port 157, and the communication port 158 are not shut off from each other by the ribs 149 but communicate with each other. That is, each of the BK cap 145 and the CO cap 144 communicate with the waste liquid tank 142 through the port switching mechanism 59.

Figure 9:
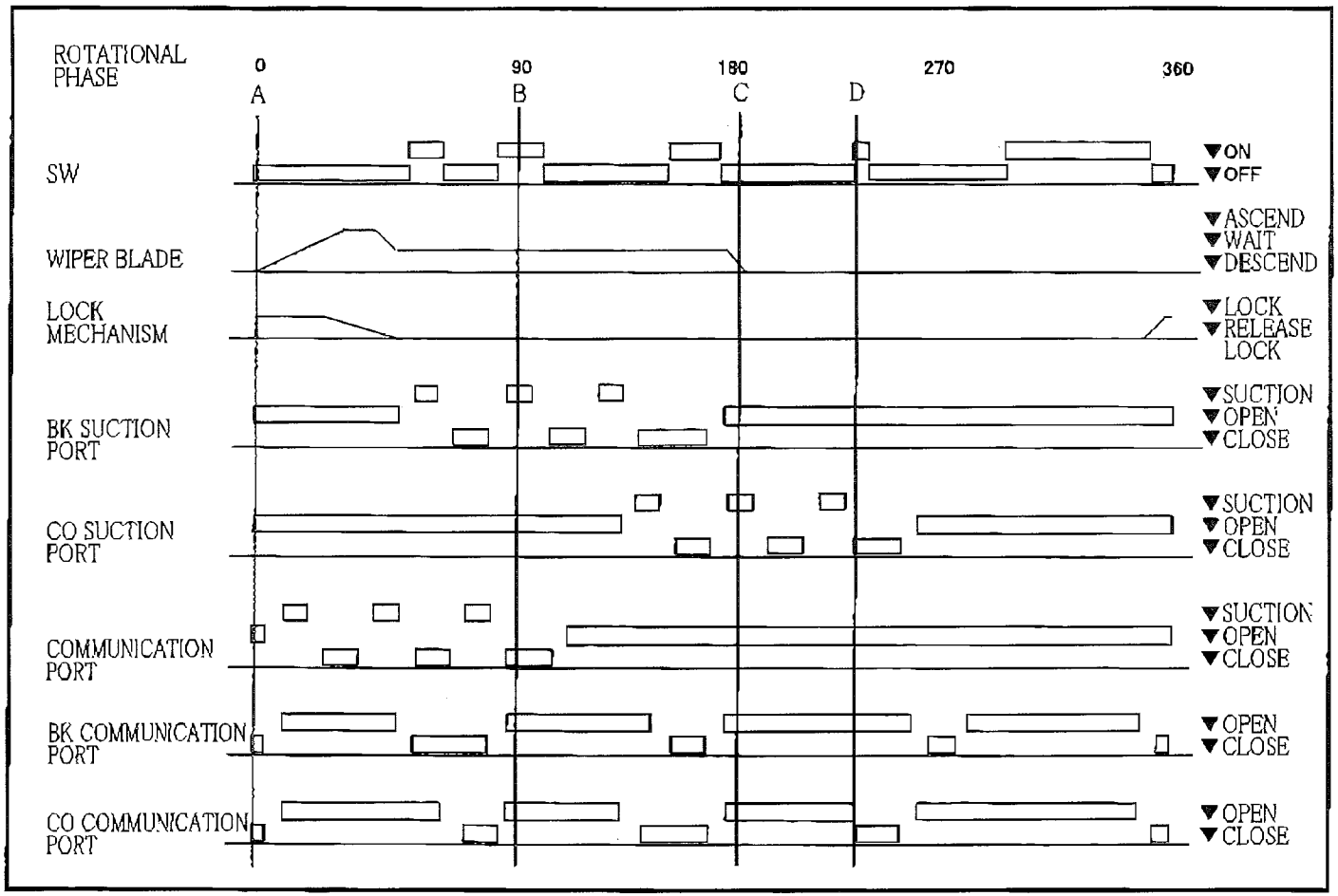
FIG. 9 is a diagram showing a relation between a rotational phase of a rotating body 148 in the port switching mechanism 59 and a condition of each of the components.

FIG. 9 shows the output of the light sensor 153, a state of the wiper blade 56, the state of the lock mechanism 146, and the state of the communication among the ports. As described above, the output of the light sensor 153 is used for the controller 135 to determine the rotational phase of the rotating body 148. Regarding the state of each of the ports, "SUCTION" means that the port communicates with the pump connection port 159, "OPEN" means that the port communicates with the outside space, and "CLOSE" means that the port is shut off from the outside space and the other ports. FIG. 9 shows that the wiper blade 56 is at the lowest position in the lock state shown as a line A in which the rotational phase is 0. This means that the wiper blade 56 is accommodated in the wiper holder 68.

In the lock state, the gear switching mechanism 170 is put into the first driving state. That is, the rotational drive force of the conveyance motor 76 is transmitted to the first conveyance roller 60, the second conveyance roller 62, the lock mechanism 146, the wiper blade 56, the port switching mechanism 59, and the pump 143.

When the controller 135 receives a command for performing an image recording from the user in the lock state, the controller 135 checks the signal from the light receiving element of the registration sensor 110. When the signal from the light receiving element of the registration sensor 110 is the LOW level signal, no recording sheet is placed on the manual feed tray 20. The controller 135 instructs the conveyance motor 76 to rotate in the first direction so as to bring the port switching mechanism 59 into a scanable state shown as a line D in FIG. 9. The scanable state is a state in which the carriage 31 is scanable in the main scanning direction (the left-right direction 9), specifically, the lock mechanism 146 is in the lock release posture and the wiper blade 56 is at the lowest position. In other words, the scanable state is a state in which the image recording is performed by the command from the user. A posture of the wiper blade 56 at this state is an example of a separate posture. According to instructions from the controller 135, the sheet supply roller 25 is driven and the recording sheet placed on the sheet supply cassette 78 is supplied to the curved passage 65A, and then an image recording is performed.

When the signal from the light receiving element of the registration sensor 110 is the HIGH level signal, it is determined that the recording sheet is placed on the manual feed tray 20. Therefore, a downstream edge of the recording sheet on the manual feed tray 20 in the forward conveying direction is almost at the nip position 60A. That is, the recording sheet is ready to be conveyed by the rotation of the conveyance motor 76 in the first direction. In this state, the controller 135 determines, on the basis of the command for the image recording from the user, whether an image recording is performed on the recording sheet placed on the manual feed tray 20 or the recording sheet placed on the sheet supply cassette 78.

A limit point P1 (an example of a second position) is defined on the first lower guide member 180, as shown in FIG. 2. Where the image recording is performed on the recording sheet placed on the manual feed tray 20, a control is performed so that an upstream edge of the recording sheet in the forward conveying direction does not go over the limit point P1 in the forward conveying direction during a switch of the port switching mechanism 59 from the lock state to the scanable state. The control performed by the controller 135 for putting the port switching mechanism 59 into the scanable state is described as follows with reference to a flow chart shown in FIG. 10. That is, the conveyance motor 76 is controlled by the controller 135 according to the flow chart shown in FIG. 10.

The controller 135 calculates a position of the upstream edge of the recording sheet in the forward conveying direction in a state in which the conveyance motor 76 has rotated in the first direction until the port switching mechanism 59 has been put into the scanable state. Then, the controller 135 determines whether or not the calculated position will go over the limit point P1 (FIG. 2) in the forward conveying direction (a step S10). This determination is performed based on the rotation amount of the conveyance motor 76, a current position of the recording sheet, and a size of the recording sheet defined by the user in the forward conveying direction.

When the controller 135 determines that the upstream edge of the recording sheet will not go over the limit point P1 (the step S10: No), the controller 135 instructs the conveyance motor 76 to rotate in the first direction until the port switching mechanism 59 is put into the scanable state (a step S20). The rotation amount of this rotation of the conveyance motor 76 is an example of a complete switch rotation amount.

Figure 5E:
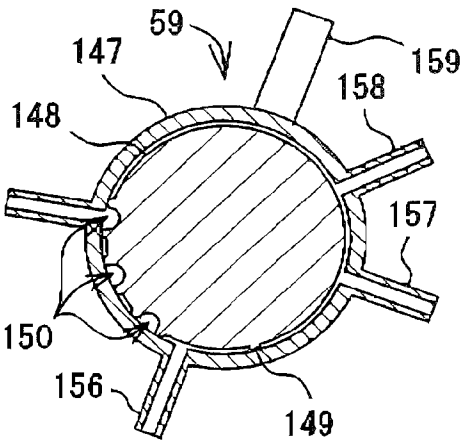
Figure 5A:
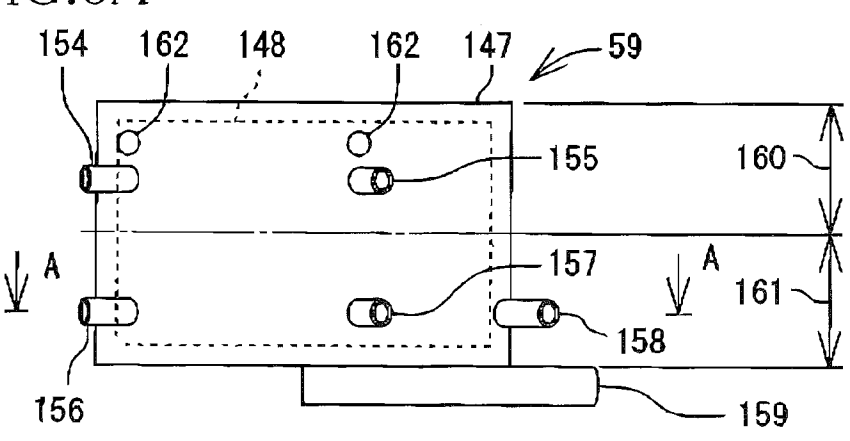
Figure 5D:
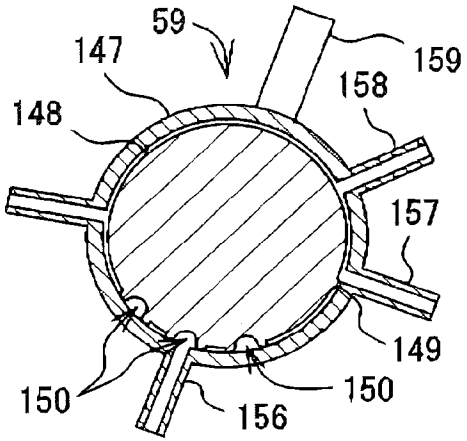
Figure 5C:
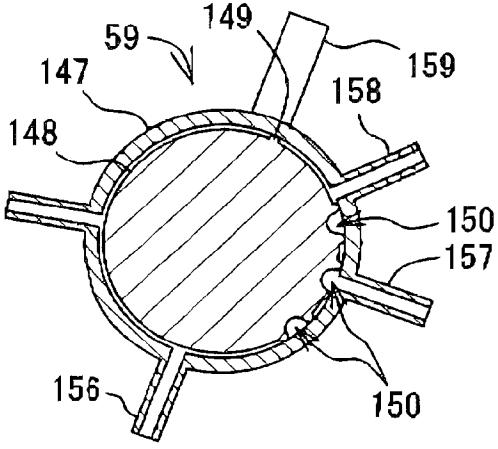

When the controller 135 determines that the upstream edge of the recording sheet will go over the limit point P1 (the step S10: Yes), the controller 135 instructs the conveyance motor 76 to rotate in the first direction so that the port switching mechanism 59 is putted into the BK empty suction state shown as a line B in FIG. 9 (a step S30). The rotation amount of this rotation of the conveyance motor 76 is an example of a first rotation amount. This rotation causes the recording sheet on the manual feed tray 20 to be conveyed in the forward conveying direction. FIG. 5C shows the rotational phase of the rotating body 148 in the BK empty suction state. The BK suction port 157 faces to one of the grooves 150 in the BK empty suction state. The one of the grooves 150 is formed along an axis of the rotating body 148 and forms a space connecting to the pump connection port 159 formed on the end face of the lower switching portion 161. That is, the BK suction port 157 communicates with the pump connection port 159 in the lower switching portion 161 in the BK empty suction state. In addition, though it is not shown in the figures, the BK communication port 155 communicates with the air hole 162 in the upper switching portion 160.

As shown in FIG. 9, while the port switching mechanism 59 is put from the lock state into the BK empty suction state, the wiper blade 56 ascends to the maximum and then descends, thereby coming into the waiting state (a state in which the wiper blade 56 is partially accommodated in the wiper holder 68). When the wiper blade 56 ascends to the maximum, the wiper blade 56 is put into a contact state. In addition, the lock by the lock mechanism 146 is released while the wiper blade 56 is in the contact state.

The controller 135 instructs the conveyance motor 76 to rotate in the second direction so that the recording sheet is moved in the backward conveying direction until the downstream edge of the recording sheet in the forward conveying direction is positioned at a reference stop position (an example of a first position) P2 shown in FIG. 2 (a step S40). The rotation amount of the conveyance motor 76 in the step S40 is calculated based on the rotation amount of the conveyance motor 76 in the first direction in the step S30. The rotation amount of this rotation of the conveyance motor 76 is an example of a second rotation amount. The downstream edge is a frontward edge of the recording sheet in the forward conveying direction.

At this time, the rotation of the conveyance motor 76 in the second direction causes the pump 143 to suction an air. This causes an air inside the BK cap 145 to be delivered to the pump 143, while the BK communication port 155 communicates with the air hole 162. Therefore, an air flows from the air hole 162 into the BK cap 145. Therefore, a pressure of the inside space of the BK cap 145 does not become negative, and the inks are not suctioned from the nozzles.

The controller 135 determines whether or not the upstream edge of the recording sheet goes over the limit point P1 (FIG. 2) in the forward conveying direction, when the conveyance motor 76 rotates in the first direction until the port switching mechanism 59 is put from the current state (the BK empty suction state) into the scanable state (a step S50). This determination is performed based on the rotation amount of the conveyance motor 76, the current position of the recording sheet, and the size of the recording sheet in the forward conveying direction.

When the controller 135 determines that the upstream edge of the recording sheet will not go over the limit point P1 (a step S50: No), the controller 135 instructs the conveyance motor 76 to, rotate in the first direction until the port switching mechanism 59 is put into the scanable state (a step S80).

When the controller 135 determines that the upstream edge of the recording sheet will go over the limit point P1 (the step S50: Yes), the controller 135 instructs the conveyance motor 76 to rotate in the first direction until the port switching mechanism 59 is put into the CO empty suction state shown as a line C in FIG. 9 (a step S60). This rotation causes the recording sheet on the manual feed tray 20 to be conveyed in the forward conveying direction. FIG. 5D shows the rotational phase of the rotating body 148 in the CO empty suction state. The CO suction port 156 faces to one of the grooves 150. That is, the CO suction port 156 communicates with the pump connection port 159 in the lower switching portion 161 in the CO empty suction state. In addition, though it is not shown in the figures, the CO communication port 154 communicates with the air hole 162 in the upper switching portion 160.

As shown in FIG. 9, the wiper blade 56 is almost at the lowest position in the CO empty suction state. Additionally, the lock by the lock mechanism 146 is released.

The controller 135 instructs the conveyance motor 76 to rotate in the second direction so that the recording sheet is moved in the backward conveying direction until the downstream edge of the recording sheet in the forward conveying direction is positioned at the reference stop position P2 shown in FIG. 2 (a step S70). The rotation amount of the conveyance motor 76 in the step S70 is calculated based on the rotation amount of the conveyance motor 76 in the first direction in the step S60.

At this time, the rotation of the conveyance motor 76 in the second direction causes the pump 143 to suction the air. This causes an air inside the CO cap 144 to be delivered to the pump 143, while the CO communication port 154 communicates with the air hole 162. Therefore, an air flows from the air hole 162 into the CO cap 144. Therefore, a pressure of the inside space of the CO cap 144 does not become negative, and the inks are not suctioned from the nozzles.

The controller 135 instructs the conveyance motor 76 to rotate in the first direction until the port switching mechanism 59 is put into the scanable state (a step S80). FIG. 5E shows the rotational phase of the rotating body 148 in the scanable state. In the lock state, the BK suction port 157 and the communication port 158 are not shut off from each other by the ribs 149 but communicate with each other. That is, the BK cap 145 communicates with the waste liquid tank 142 through the port switching mechanism 59. The state of the communication among the ports in the port switching mechanism 59 shown in FIG. 5E is an example of a first communication state.

As shown in FIG. 9, the wiper blade 56 is at the lowest position in the scanable state. Additionally, the lock mechanism is in the lock release posture.

Figure 10:
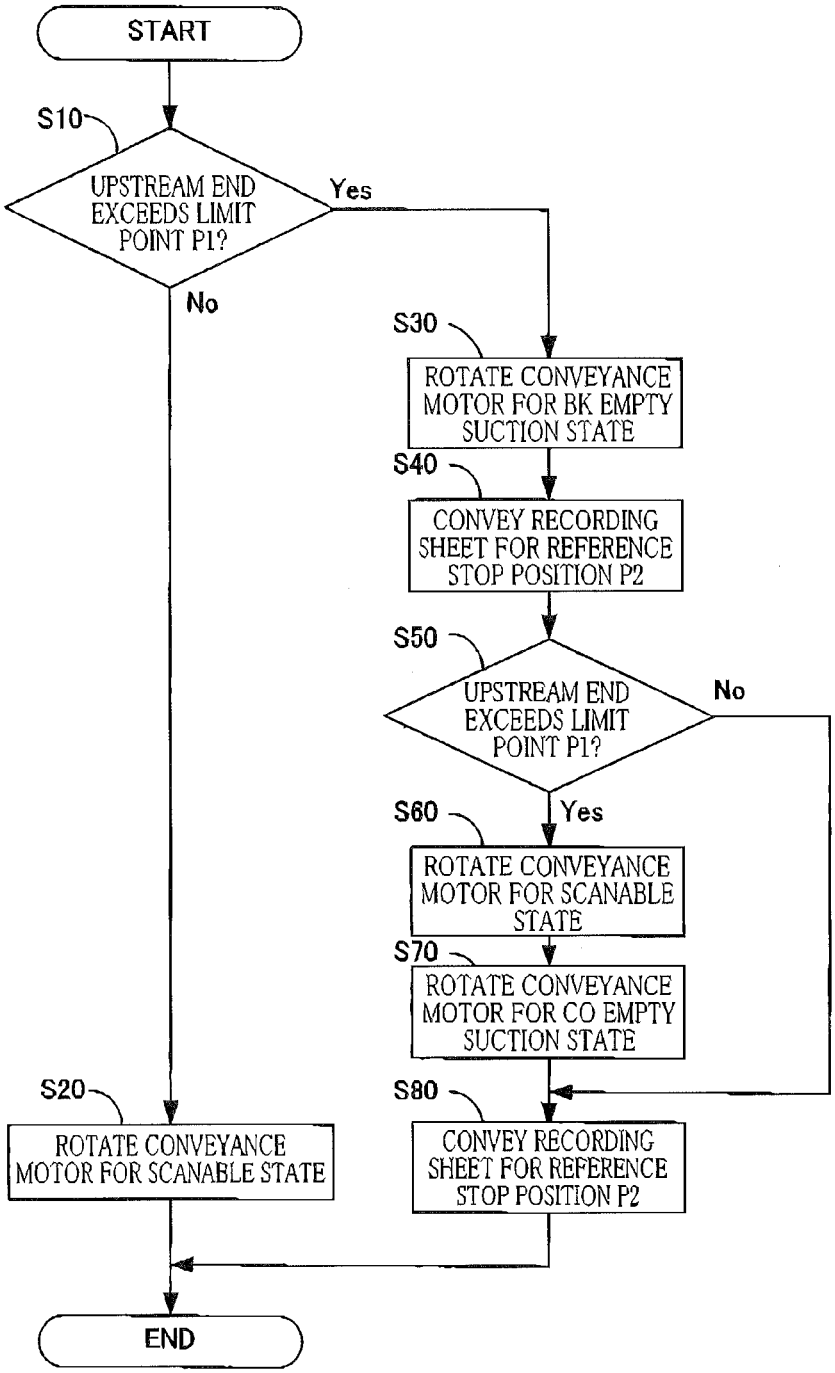
FIG. 10 shows a flow chart showing a process performed by the controller 135 in a change of the port switching mechanism 59 from the lock state to the scanable state.

Though it is not shown in the flow chart of FIG. 10, the controller 135 instructs the carriage 31 to move away from the pushed lever 91 (leftward in FIG. 3) after the port switching mechanism 59 is put in the scanable state, whereby the lift-up mechanism 55 separates the cap 46 away from the recording head 30. Afterward, the carriage 31 pushes the switch lever 176, whereby the gear switching mechanism 170 is put into the second driving state. In this state, the controller 135 instructs the conveyance motor 76 to rotate in the second direction. This causes a rotation of the sheet supply roller 25, whereby the recording sheet is conveyed to the conveyance path 65. When the downstream edge of the recording sheet in the forward conveying direction reaches to the first conveyance roller 60, the controller 135 instructs the conveyance motor 76 to rotate in the first direction. This causes a rotation of the first conveyance roller 60, whereby the recording sheet is conveyed to the recording unit 24.

Example of Conveyance Distance in Switch to Scanable State

FIG. 12 shows examples of distances in which the recording sheet is conveyed while the port switching mechanism 59 is put from the lock state into the scanable state. Hereinafter, a term "conveyance distance" means a distance in which the recording sheet is conveyed. A "sheet position" means a position of the downstream edge of the recording sheet in the forward conveying direction with respect to the nip position 60A. The conveyance distance and the sheet position are expressed positively in the forward conveying direction. The conveyance distance and the sheet position in FIG. 12 are just examples and thus may be different from accurate values.

In the lock state, the recording sheet on the manual feed tray 20 is at about the nip position 60A. In the step S30, while the port switching mechanism 59 is put into the BK empty suction state, the recording sheet is conveyed by 39 mm. Consequently, the sheet position is 39 mm. In the step S40, the pump 143 is driven in order to put the downstream edge of the recording sheet at the sheet position of 10 mm (the reference stop position P2), whereby the recording sheet is conveyed in the backward conveying direction by 29 mm. That is, the recording sheet is conveyed by −29 mm in the forward conveying direction. Similarly, in the step S60, when the port switching mechanism 59 is put into the CO empty suction state, the recording sheet is conveyed by 35 mm. Consequently, the sheet position is 45 mm. In the step S70, the pump 143 is driven in order to put the downstream edge of the recording sheet at the sheet position of 10 mm, whereby the recording sheet is conveyed in the backward conveying direction by 35 mm. That is, the recording sheet is conveyed by −35 mm in the forward conveying direction. In the step S80, when the port switching mechanism 59 is put into the scanable state, the recording sheet is conveyed by 20 mm. Consequently, the sheet position is 30 mm. Accordingly, the maximum sheet position is 45 mm in the examples according to a table of FIG. 12. If the drives of the pump 143 (the rotations of the conveyance motor 76 in the second direction) were not performed, the maximum sheet position would be 39+35+20=94 mm. For example, if the recording sheet of an L-size paper having a length of 127 mm in the forward conveying direction were at the sheet position of 94 mm, the upstream edge of the recording sheet would be located downstream of the limit point P1 in the forward conveying direction. On the other hand, when the recording sheet of the L-size paper is at the sheet position of 45 mm, the upstream edge of the recording sheet is upstream of the limit point P1 in the forward conveying direction.

Working Effect of the Embodiment

The recording sheet conveyed in the forward conveying direction by the rotation of the conveyance motor 76 in the first direction is conveyed in the backward conveying direction by the rotation of the conveyance motor 76 in the second direction. That is, since the conveyance motor 76 is controlled so that the upstream edge of the recording sheet in the forward conveying direction does not go over the limit point P1, the first conveyance roller 60 does not convey the recording sheet too far in the forward conveying direction. Therefore, even when the recording sheet is conveyed in the backward conveying direction at a start of the image recording, the recording sheet is not faultily conveyed into the curved passage 65A.

In addition, since the downstream edge of the recording sheet in the forward conveying direction is stopped at the reference stop position P2, the recording sheet is not conveyed by the backward conveyance beyond the nip position 60A of the first conveyance roller 60 in the forward conveying direction. Moreover, the recording sheet is kept at an appropriate position with respect to the first conveyance roller 60.

In addition, since a suction port of the pump 143 communicates with the outside space through the air hole 162 in the BK empty suction state and the CO empty suction state, the pressure of the inside space of the cap 46 does not decrease, and thus the nozzles are not suctioned. That is, the inks are not consumed.

When it is determined that the upstream edge of the recording sheet does not go over the limit point P1, the controller 135 instructs the conveyance motor 76 to rotate in the first direction so as to put the port switching mechanism 59 into the scanable state. Therefore, a time required for the port switching mechanism 59 to be put into the scanable state is reduced.

In addition, since the state of the port switching mechanism 59 is determined based on not only the signal inputted from the light sensor 153 but also the number of the pulse signals inputted from the rotary encoder 141, the port switching mechanism 59 is controlled more accurately.

In addition, since the port switching mechanism 59 switches the state of the communication among the ports by the rotation of the rotating body 148, the switch is easily performed by the rotation of the conveyance motor 76.

In addition, the lock mechanism 146 prevents the cap 46 from being put into the second posture, and the wiper blade 56 wipes out the unnecessary inks staying on the nozzle face 48. In the image recording, the lock mechanism 146 release the lock, and the first conveyance roller 60 does not convey the recording sheet too far in the forward conveying direction.

Modified Embodiment

A modified embodiment of the aforementioned embodiment is described as follows. In the aforementioned embodiment, the lock of the lift up mechanism 55 by the lock mechanism 146 is released in the switch of the port switching mechanism 59 from the lock state to the BK empty suction state. However, this construction is just an example, and the lock by the lock mechanism 146 may be released in the subsequent states. For example, the lock may be released just before the switch to the scanable state in the switch of the port switching mechanism 59 from the CO empty suction state to the scanable state. This prevents the cap 46 from being put into the second posture until just before the switch of the port switching mechanism 59 to the scanable state.

In addition, the number of the rotations of the conveyance motor 76 in the second direction may be more than that in the aforementioned embodiment. For example, the number of the rotations of the conveyance motor 76 in the second direction may be the same as the number of the rotations of the conveyance motor 76 in the first direction.

In addition, the state of the port switching mechanism 59 in the drive of the conveyance motor 76 may be a state in which the pump connection port 159 communicates with the outside space, and it is not necessary for the pump connection port 159 to communicate with the BK cap 145 and the CO cap 144.

In addition, it is not necessary that the port switching mechanism 59 is a rotational type, but the port switching mechanism 59 may be configured to switch the state of the communication among the ports by the rotation of the conveyance motor 76.

What is claimed is:

1. An ink-jet recording apparatus comprising:

a manual feed tray on which a sheet is placed;

a motor rotatable in a first direction and a second direction opposite to the first direction;

a conveyance roller configured to be rotated in a forward direction by a transmission of a rotation of the motor in the first direction so that the sheet on the manual feed tray is supplied into a conveyance path and is conveyed in a conveying direction, the conveyance roller being configured to be rotated in a reverse direction opposite to the forward direction by a transmission of a rotation of the motor in the second direction;

an encoder configured to detect a rotation of the conveyance roller;

a recording head disposed downstream of the conveyance roller in the conveying direction and having a nozzle face on which a plurality of nozzles are formed, the recording head being configured to eject an ink to record an image on the sheet;

a cap configured to be put into a first posture in which the cap covers the nozzle face and into a second posture in which the cap is away from the nozzle face;

a suction pump configured to be driven by a transmission of the rotation of the motor in the second direction;

a switching portion comprising a plurality of ports including at least a first port and a second port, wherein the switching portion is configured to switch a state of communication between the first port and the second port by a transmission of the rotation of the motor in the first direction, the first port being connected to a suction port of the suction pump, the second port communicating with an inside space of the cap; and a controller electrically connected to the motor and the encoder, wherein, when the controller receives an image recording command for the sheet placed on the manual feed tray in a state in which the cap is in the first posture, the controller is configured to rotate the motor in the first direction by a first rotation amount smaller than a complete switch rotation amount, the complete switch rotation amount being a rotation amount of the motor required to put the state of the communication into a first communication state, which is a state of the switching portion in which recording is performed, wherein the controller is configured to rotate the motor in the second direction by a second rotation amount equal to or less than the first rotation amount after the rotation of the motor in the first direction by the first rotation amount, and wherein the controller is configured to rotate the motor in the first direction by a difference rotation amount between the complete switch rotation amount and the first rotation amount so that the state of the communication is put into the first communication, after the rotation of the motor in the second direction by the second rotation amount.

2. The ink jet recording apparatus according to claim 1, wherein the switching portion is configured not to switch the state of the communication by a rotation of the motor in the second direction.

3. The ink-jet recording apparatus according to claim 1, wherein the second rotation amount is a rotation amount of the motor in the second direction required for a downstream edge of the sheet in the conveying direction to be positioned at a predetermined first position located downstream of a position where the sheet comes into contact with the conveyance roller, in the conveying direction.

4. The ink-jet recording apparatus according to claim 3, wherein the first position is located upstream of the recording head in the conveying direction.

5. The ink-jet recording apparatus according to claim 1, wherein the first rotation amount is a rotation amount of the motor in the first direction required for the inside space of the cap to communicate with an outside space of the cap through the switching portion.

6. The ink-jet recording apparatus according to claim 1, wherein the controller is configured to calculate, on the basis of a size of the sheet in the conveying direction, a position of an upstream edge of the sheet in the conveying direction when the motor is rotated in the first direction by the complete switch rotation amount, and wherein the controller is configured to rotate the motor in the first direction by the complete switch rotation amount where the calculated position of the upstream edge is located upstream of a predetermined second position in the conveying direction.

7. The ink-jet recording apparatus according to claim 6, further comprising a sheet supply tray on which the sheet is placed, the sheet supply tray being below the conveyance path wherein the second position is located upstream of a junction position in the conveying direction, the junction position being a position where the conveyance path joins with a first conveyance path through which the sheet is conveyed from the sheet supply tray.

8. The ink-jet recording apparatus according to claim 1, wherein the controller is configured to store information regarding a relation between a count number of the encoder and the state of the communication of the switching portion.

9. The ink-jet recording apparatus according to claim 1, wherein the switching portion comprises:

a hollow cylinder in which the plurality of ports are formed;

a rotation body having a circular shape rotatable inside the cylinder and configured to rotate while sliding on an inner face of the cylinder; and a detector electrically connected to the controller and configured to detect a rotation of the rotation body.

10. The ink-jet recording apparatus according to claim 1, further comprising:

a lock mechanism configured to lock the cap in the first posture and release locking of the cap in the first posture, by the transmission of the rotation of the motor in the first direction; and a wiper configured to change a posture thereof into a contact posture and a separate posture by the transmission of the rotation of the motor in the first direction, and configured to wipe the nozzle face in the contact posture, the contact posture being a posture in which the wiper is contactable with the nozzle, the separate posture being a posture in which wiper is away from wipe out the nozzle face, wherein a third rotation amount of the motor in the first direction is larger than the first rotation amount, the third rotation amount of the motor being a rotation amount required in a process in which the lock mechanism releases the locking of the cap in the first posture and the wiper changes the posture thereof from the contact posture to the separate posture.

11. The ink-jet recording apparatus according to claim 10, further comprising a carriage on which the recording head is mounted, configured to be driven by a drive source other than the motor so as to move in a main scanning direction intersecting with the conveying direction, wherein the cap not locked in the first posture is configured to change in the posture thereof between the first posture and the second posture in association with a movement of the carriage.

* * * * *